US006966291B1

(12) United States Patent
Fischer et al.

(10) Patent No.: US 6,966,291 B1
(45) Date of Patent: Nov. 22, 2005

(54) LATCH TIMING MECHANISM FOR A TWO-STEP ROLLER FINGER CAM FOLLOWER

(75) Inventors: Thomas H. Fischer, Rochester, NY (US); Andrew J. Lipinski, Henrietta, NY (US); Timothy W. Kunz, Rochester, NY (US); Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/975,866

(22) Filed: Oct. 28, 2004

(51) Int. Cl.[7] ..... F01L 1/18

(52) U.S. Cl. ..... 123/90.39; 123/90.16; 123/90.44

(58) Field of Search ..... 123/90.15, 90.16, 123/90.17, 90.18, 90.27, 90.31, 90.39, 90.44, 123/90.45, 90.52

(56) References Cited

U.S. PATENT DOCUMENTS

| | | | | |
|---|---|---|---|---|
| 6,591,798 | B2 * | 7/2003 | Hendriksma et al. | 123/90.16 |
| 6,668,775 | B2 * | 12/2003 | Harris | 123/90.16 |
| 6,691,657 | B2 * | 2/2004 | Hendriksma et al. | 123/90.39 |
| 6,755,167 | B2 | 6/2004 | Krieg et al. | |

* cited by examiner

*Primary Examiner*—Thomas Denion
*Assistant Examiner*—Ching Chang
(74) *Attorney, Agent, or Firm*—Jimmy L. Funke

(57) ABSTRACT

In a two-step roller finger cam follower, a slider arm for engaging a high-lift cam lobe is pivotally mounted to the body and can variably engage a latch pin slidably disposed in a latch pin channel. A second channel in the body opens onto the slider arm and contains a timing pin that rides on an eccentric surface of the slider arm to extend or retract the timing pin. A bore between the latch pin channel and the timing pin channel contains a ball controlled by the timing pin to lock the latch pin into an engaged or disengaged position. The cam lobe has an undercut region such that the latch pin is allowed to move between engaged and disengaged position only when the slider arm is in the undercut region of the cam lobe. The latch pin can move only when the timing pin permits.

8 Claims, 5 Drawing Sheets

LATCH TIMING MECHANISM FOR A TWO-STEP ROLLER FINGER CAM FOLLOWER

TECHNICAL FIELD

The present invention relates to roller finger followers used for variable valve actuation in overhead cam type internal combustion engines, and more particularly to a variable actuation roller finger follower wherein a timing pin mechanism is disposed adjacent a latch pin such that the latch pin can engage with and disengage from a high-lift slider only when the slider is on a "negative lift" portion of the associated high-lift cam lobe.

BACKGROUND OF THE INVENTION

Roller finger followers (RFF) are widely used in overhead cam internal combustion engines to sequentially open and close the cylinder intake and exhaust valves. In a typical application, the RFF serves to transfer and translate rotary motion of a cam shaft lobe into a pivotal motion of the RFF to thereby open and close an associated valve.

It is known that, for a portion of the duty cycle of a typical multiple-cylinder engine, the performance load can be met by a functionally smaller engine having fewer firing cylinders, and that at low-demand times fuel efficiency can be improved if one or more cylinders of a larger engine can be withdrawn from firing service. It is also known that at times of low torque demand, valves may be opened to only a low lift position to conserve fuel, and that at times of high torque demand, the valves may be opened wider to a high lift position to admit more air/fuel mixture or air. It is known in the art to accomplish these valve actuations by de-activating a portion of the valve train associated with pre-selected cylinders in any of various ways. One way is by providing a special two-step RFF having a variably activatable and deactivatable central slider or roller which may be positioned as needed for contact with a high lift lobe of the cam shaft. Such a two-step RFF typically is also configured with a pair of rollers disposed at each side of the slider for contact with low lift lobes of the cam shaft on either side of the high-lift lobe. Thus, the two-step RFF causes low lift of the associated valve when the slider of the RFF is in a deactivated (lost motion) position, and high lift of the associated valve when the slider of the RFF is latched in an activated position to engage the high lift lobe of the cam shaft.

One such two-step RFF known in the art is disclosed in U.S. Pat. No. 6,755,167 B2, issued Jun. 29, 2004, the relevant disclosure of which is incorporated herein by reference. In this roller finger follower, an elongate body having first and second side members defines coaxially disposed shaft orifices. A pallet end and a socket end interconnect with the first and second side members to define a central slider aperture and a latch pin channel. The socket end is adapted to mate with a mounting element such as an hydraulic lash adjuster, and the pallet end is adapted to mate with a valve stem, pintle, lifter, or the like. A slider for engaging a high-lift cam lobe is disposed in the slider aperture and has first and second ends, the first end of the slider being pivotally mounted to the pallet end of the body and the second end defining a slider tip for engaging an activation/deactivation latch. The latch pin is slidably disposed in the latch pin channel, the latch pin having a nose section for selectively engaging the slider tip. A spool-shaped roller comprising a shaft and opposed roller elements fixedly attached to ends of the shaft is rotatably disposed in the shaft orifices, the roller being adapted to follow the surface motion of two outboard low-lift cam lobes. Preferably, the shaft is journalled in roller or needle bearings which extend between and through both the first and second shaft orifices.

A drawback of such a roller finger follower is that the latching pin can inadvertently be partially engaged with the slider when the slider is at initial stage of lost motion. The resulting forces between the slider and the latching pin can exceed the hydraulic force available to hold the latch pin position, resulting in the latching pin being ejected (retracted) into the bore in the finger follower. This event results in undesirable noise, wear and error in the calculation of the needed amount of fuel required for a stoichimetric air fuel mixture if the election occurs at a high valve lift position.

It is an object of the invention to improve component durability by controlling the time available during a cam rotation cycle for the slider locking mechanism to transition between its extreme positions.

SUMMARY OF THE INVENTION

Briefly described, a roller finger follower for use in conjunction with a cam shaft of an internal combustion engine comprises an elongate body having first and second side members defining coaxially disposed shaft orifices. A pallet end and a socket end interconnect with the first and second side members to define a slider arm aperture and a latch pin channel in the body. The socket end of the body is adapted to mate with a mounting element such as an hydraulic lash adjuster, and the pallet end of the body is adapted to mate with a valve stem, pintle, lifter, or the like.

A slider arm for engaging a high-lift cam lobe is disposed in the slider arm aperture and has first and second ends, the first end of the slider arm being pivotally mounted via a pin to the pallet end of the body and the second end defining a slider tip for engaging an activation/deactivation latch pin. The latch pin is slidably disposed in a latch pin channel, the latch pin having a nose section for extending from the channel to selectively engage the slider tip.

A spool-shaped roller comprising a shaft and opposed roller elements fixedly attached to the shaft is rotatably disposed in the shaft orifices, the rollers being adapted to follow the surface motion of outboard low-lift cam lobes. Preferably, the shaft is journalled in roller or needle bearings which extend between and through both the first and second shaft orifices, being thus exposed to normal copious oil flow through central regions of the RFF.

Adjacent the latch pin channel is a second channel in the body opening onto the slider arm and containing a spring-biased timing pin having two portions of differing diameters. The nose of the timing pin rides on an eccentric surface of the slider arm to extend or retract the timing pin. A transverse bore extends between the latch pin channel and the timing pin channel and contains a free ball. The latch pin is provided with first and second annular grooves corresponding to the position of the transverse bore and ball when the latch pin is in the fully engaged and fully disengaged positions. When the timing pin is fully extended by the eccentric surface, the ball is forced by the larger diameter portion into either of the annular grooves, thus locking the latch pin mechanically rather than hydraulically into a fully engaged or fully disengaged position, depending upon which groove is presented to the ball. When the timing pin is retracted by the eccentric surface, the ball may disengage from the annular grooves, allowing the latch pin to move between positions. The associated cam lobe includes an undercut region of the base circle portion that provides "negative lift" to the slider arm. The negative lift allows the slider arm to be pivoted by the return spring such that the timing pin is forced by a feature on the slider arm to a position wherein the ball may be forced from a latch pin groove by hydraulic pressure on the latch pin. Thus, the latch pin is allowed to begin movement between engaged and disengaged positions only when the slider arm is on the base circle portion of the cam lobe, well away from the high-lift portion. The timing of the hydraulic pressurizing and de-pressurizing of the latch pin thus is much less rigorous than in the prior art. The latch pin may be pressurized or de-pressurized at any point in the cam rotation cycle, although the latch pin can begin movement only when the mechanically-timed timing pin permits.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENT

Figure 1:
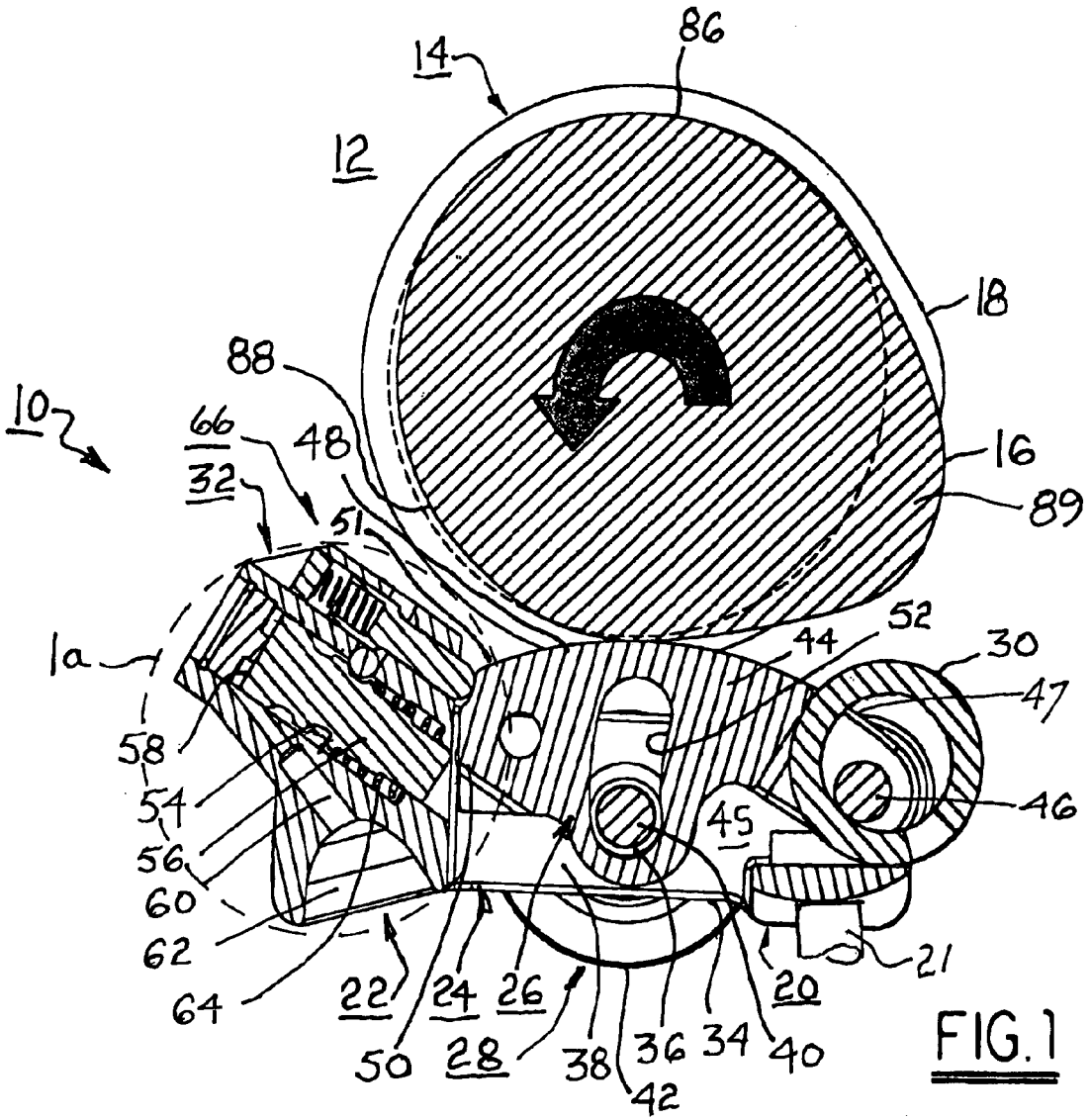
FIG. 1 is a cross-sectional view of a first position of an improved roller finger follower in accordance with the invention, wherein the slider arm is on the base circle portion of the cam, the latch pin is disengaged from the slider arm in low-lift (lost motion) mode, and the timing pin is extended in lock position.
Figure 2:
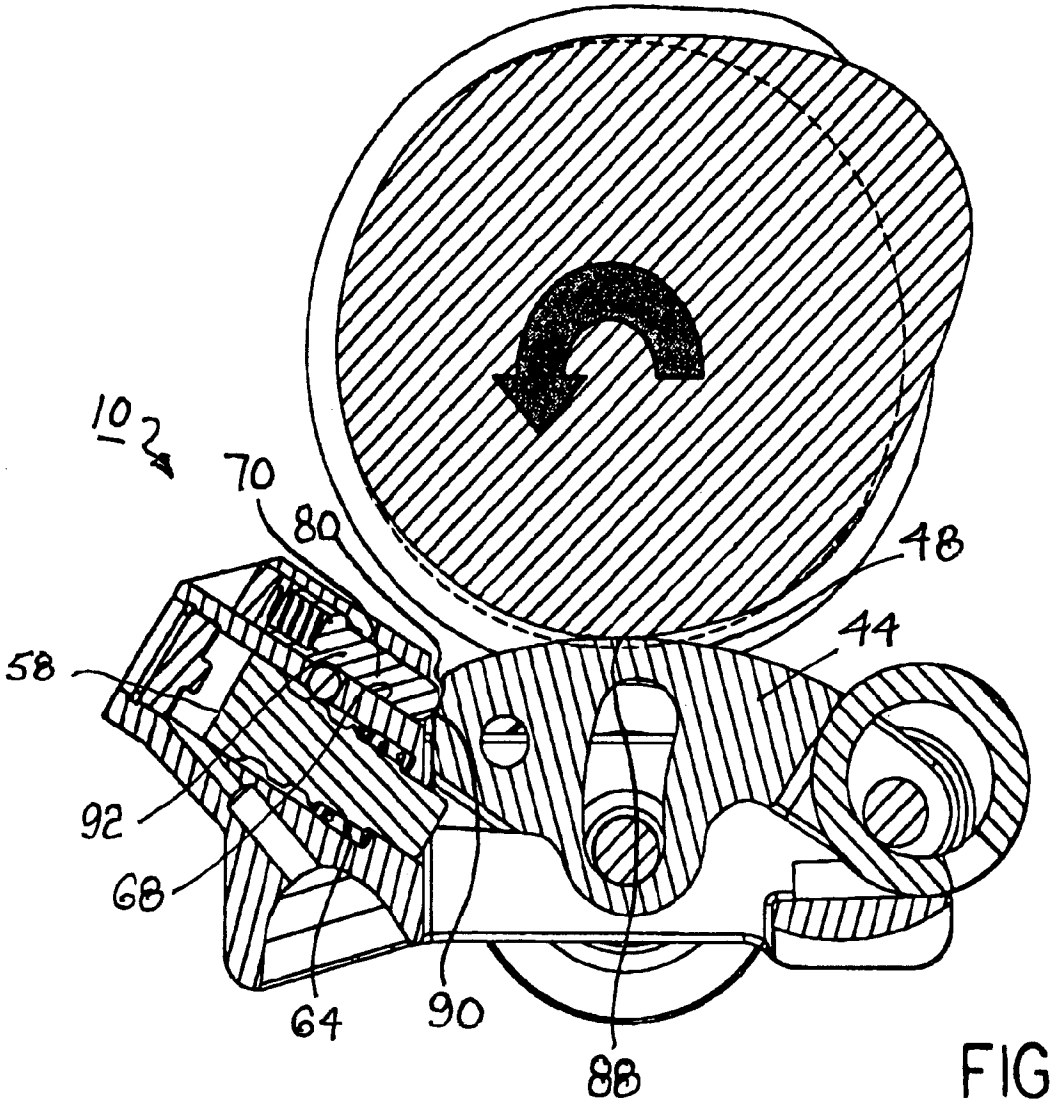
FIG. 2 is a cross-sectional view of a second position of the improved roller finger follower shown in FIG. 1, wherein the slider arm is on an undercut region of the cam, the timing pin is retracted in unlock position, and the latch pin is permitted to move into the engaged position.
Figure 3:
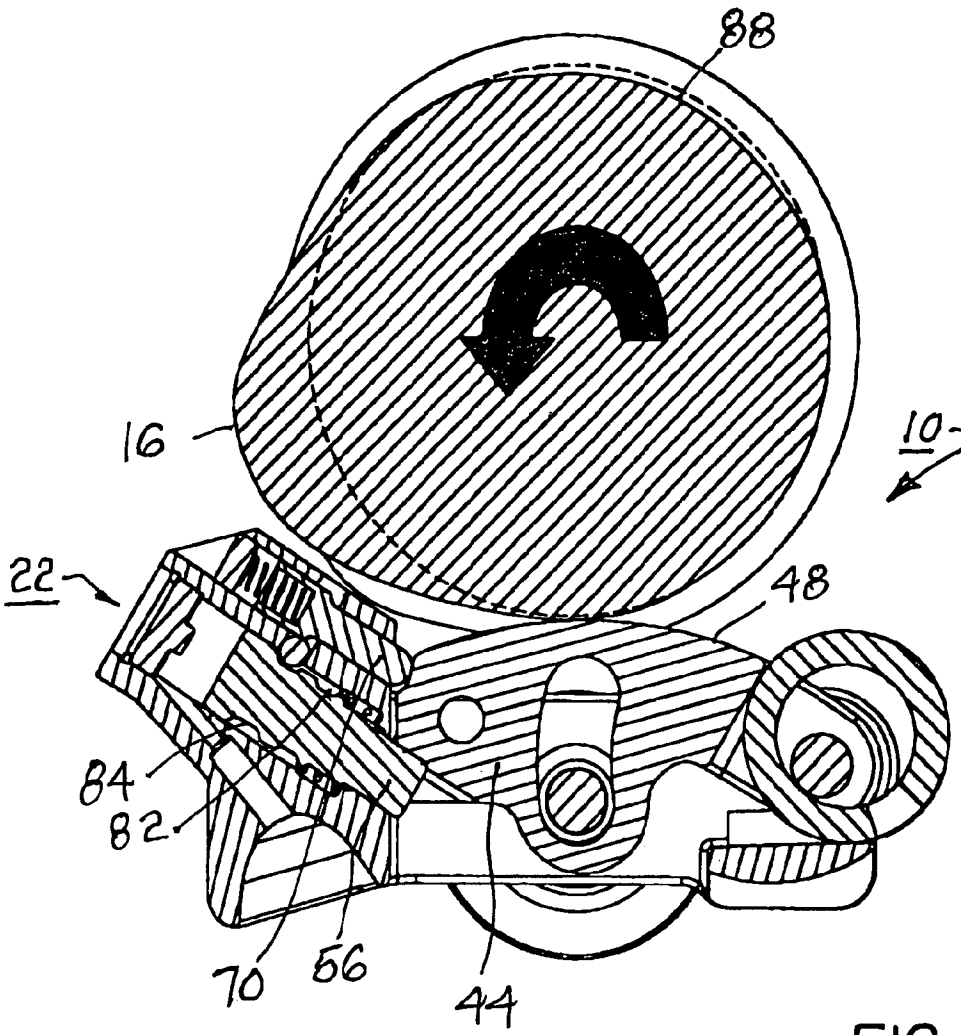
FIG. 3 is a cross-sectional view of a third position of an improved roller finger follower in accordance with the invention, wherein the slider arm is on the high-lift portion of the cam, the latch pin is engaged with the slider arm in high-lift (full valve actuation) mode, and the timing pin is again extended in lock position.

Referring to FIGS. 1 through 3, improved two-step roller finger follower 10 is shown. RFF 10 is intended for use with an internal combustion engine 12 comprising a cam 14 having a central high-lift lobe 16 flanked by a pair of low-lift lobes 18. High-lift lobe 16 includes base circle portion 86 and positive lift region 89. The high lift lobe is either enabled by latching of a central slider arm 44 pivotable within the RFF, or disabled by unlatching the central slider arm and allowing it to pivotably follow the high-lift lobe in lost motion as further described below.

Referring to FIG. 1, a pallet end 20 of RFF 10 is provided for engaging a valve stem 21 and a socket end 22 of RFF 10 is provided for engaging the hemispherical head of a hydraulic lash adjuster (not shown) in known fashion, the valve stem and socket head being conventional elements of engine 12. RFF 10 includes body assembly 24, slider arm assembly 26, spool roller assembly 28, lost motion spring 30, and latch assembly 32 (shown in detail in FIG. 1*a* as described further below).

Body assembly 24 includes elongate body 34 and roller bearings 36 disposed in bearing orifices in body sidewalls 38. A cross-shaft 40 is rotatably disposed in bearings 36 and is supportive of rollers 42 on the ends thereof for following the low-lift cam lobes 18. Of course, as RFF 10 is shown in elevational cross-sections in FIGS. 1 through 3, only one each of the body sidewalls 38, bearings 36, low-lift cam lobes 18, and rollers 42 is visible.

Slider arm assembly 26 includes slider arm 44, received in slider aperture 45 of body 34, and slider shaft 46 for pivotably attaching end 47 of arm 44 to body 34. Slider arm 44 includes: slider surface 48 for following high lift cam lobe 16; slider tip 50 at end 51; and arcuate roller shaft clearance aperture 52.

In improved RFF 10 as shown in FIGS. 1 through 3, return spring 30 is preferably a torsion spring, although a compression spring disposed in a first pocket formed in slider arm 44 and a second pocket formed in body 34 (assembly not shown) may be employed as desired.

Referring again to FIG. 1, socket end 22 of body 34 defines a latch pin channel 54 for receiving a latch pin 56. Channel 54 and latch pin 56 define a path along which the latch pin moves in engaging slider tip 50 to lock or unlock the slider between high and low lift positions. Latch pin 56 is hydraulically urged into latching position by oil provided to outer end 58 via a passage 60 in communication with HLA socket 62, the actuating oil being supplied in known fashion on command from an engine control module (ECM, not shown). A latch return spring 64 in channel 54 is compressed by actuation of the latch pin and serves to unlatch the mechanism when the hydraulic pressure is removed.

Figure 1A:
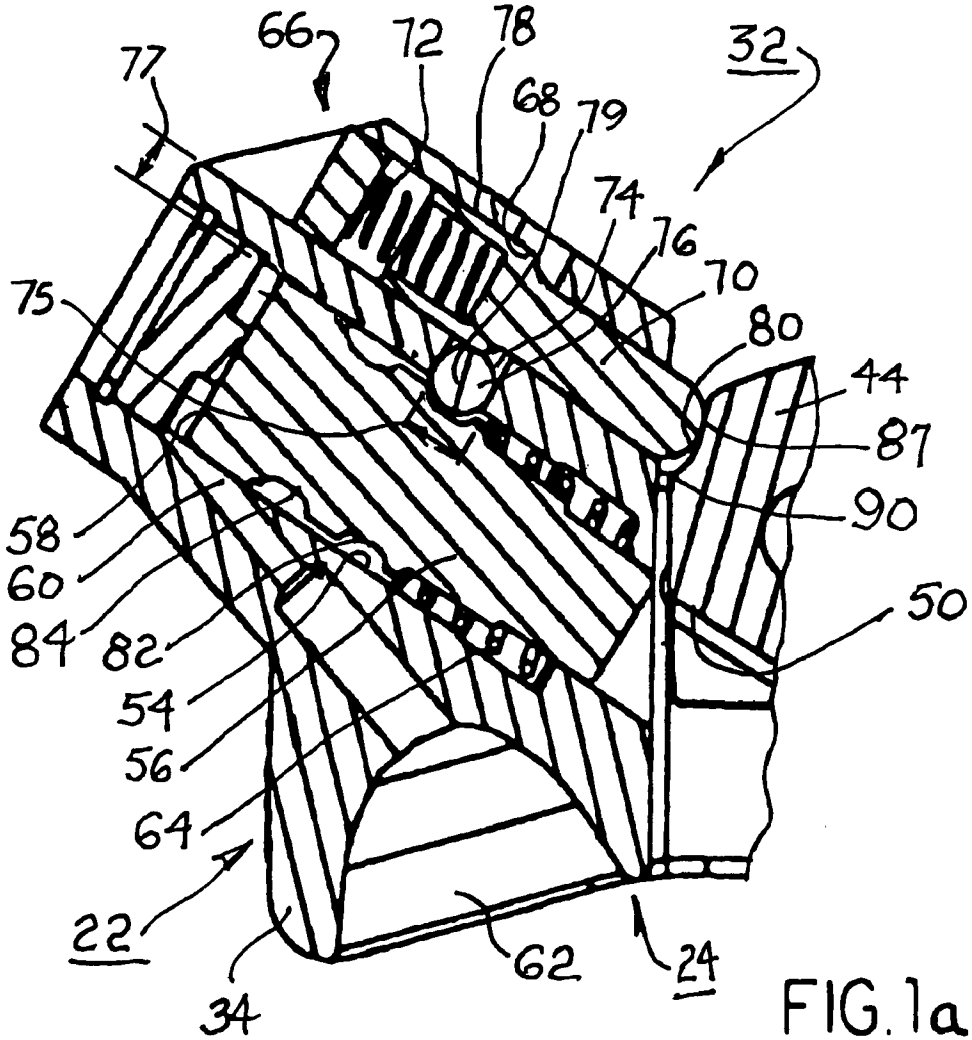
FIG. 1*a* is a detailed cross-sectional view of the latch timing mechanism taken from circle 1*a* in FIG. 1.

Referring now to FIG. 1*a*, latch assembly 32 includes the latch pin and actuation elements just described. Body assembly 24 includes timing mechanism 66 in accordance with the invention. Second timing pin channel 68 of mechanism 66 is provided in socket end 22 of body 34 parallel with latch pin channel 54 and opening onto slider arm 44 for slidably receiving a timing pin 70. Timing pin 70 captures a return spring 72 that is biased to urge pin 70 along channel 68 toward slider arm 44. A transverse passage 74 between latch pin channel 54 and timing pin channel 68 contains a free ball 76. The diameter of ball 76 is greater than the length of passage 74 such that a portion of ball 76 must always extend into either one of channels 54 and 68. Timing pin 70 is provided with a shouldered portion 78 positioned such that when timing pin 70 is extended into a detent 80 formed in the nose of slider arm 44, ball 76 is extended into channel 54. Latch pin 56 is provided with first and second annular grooves 82,84 corresponding respectively to unlatched and latched axial positions of pin 56 with respect to slider tip 50.

The remainder of the apparatus of the invention is best disclosed by describing an operating cycle of the latching mechanism.

In operation, as shown in FIGS. 1 through 4, when slider surface 48 is on the base circle portion 86 of high-lift lobe 16 (FIG. 1), the rounded end 87 of timing pin 70 is seated in detent 80, positioning ball 76 in both groove 82 and passage 74 and thereby mechanically locking latch pin 56 in its disengaged position.

Observe that the base circle portion 86 is provided with an undercut region 88 such that slider arm 44 in following the cam is urged into a "negative lift" attitude by spring 30 when passing over region 88. As shown in FIG. 2, the pivoting of arm 44 causes a rim feature 90 of detent 80 to be drawn into contact with the end of timing pin 70, forcing pin 70 to be retracted slightly in channel 68 against spring 72. The retraction is sufficient to bring a smaller diameter portion 92 of pin 70 into communication with passage 74, permitting ball 76 to move in passage 74 out of interference with latch pin 56. If hydraulic pressure has been loaded previously onto end 58 of pin 56 by the ECM, latch pin 56 is immediately urged into latching engagement with slider arm 44 while the slider arm is still on region 88 to provide high-lift capability of RFF 10. If continued low-lift operation is desired and no pressure has been loaded onto end 58, latch pin 56 remains held in the disengaged position by spring 64.

Thus, on each revolution of the cam, the slider arm is positioned by undercut region 88 to offer engagement of the latch pin, if desired, at that point in the cycle, and only at that point. Thus is prevented the well-known prior art timing error of partial engagement wherein latching of the latch pin is attempted when the slider is just beginning to move off of the base circle portion of the cam lobe, which can result in malfunction of the RFF or damage thereto, and in worst case can lead to locking of the slider in the wrong position. The latch pin is mechanically permitted to move, by freeing of the ball, only during RFF contact with undercut region 88.

Figure 4:
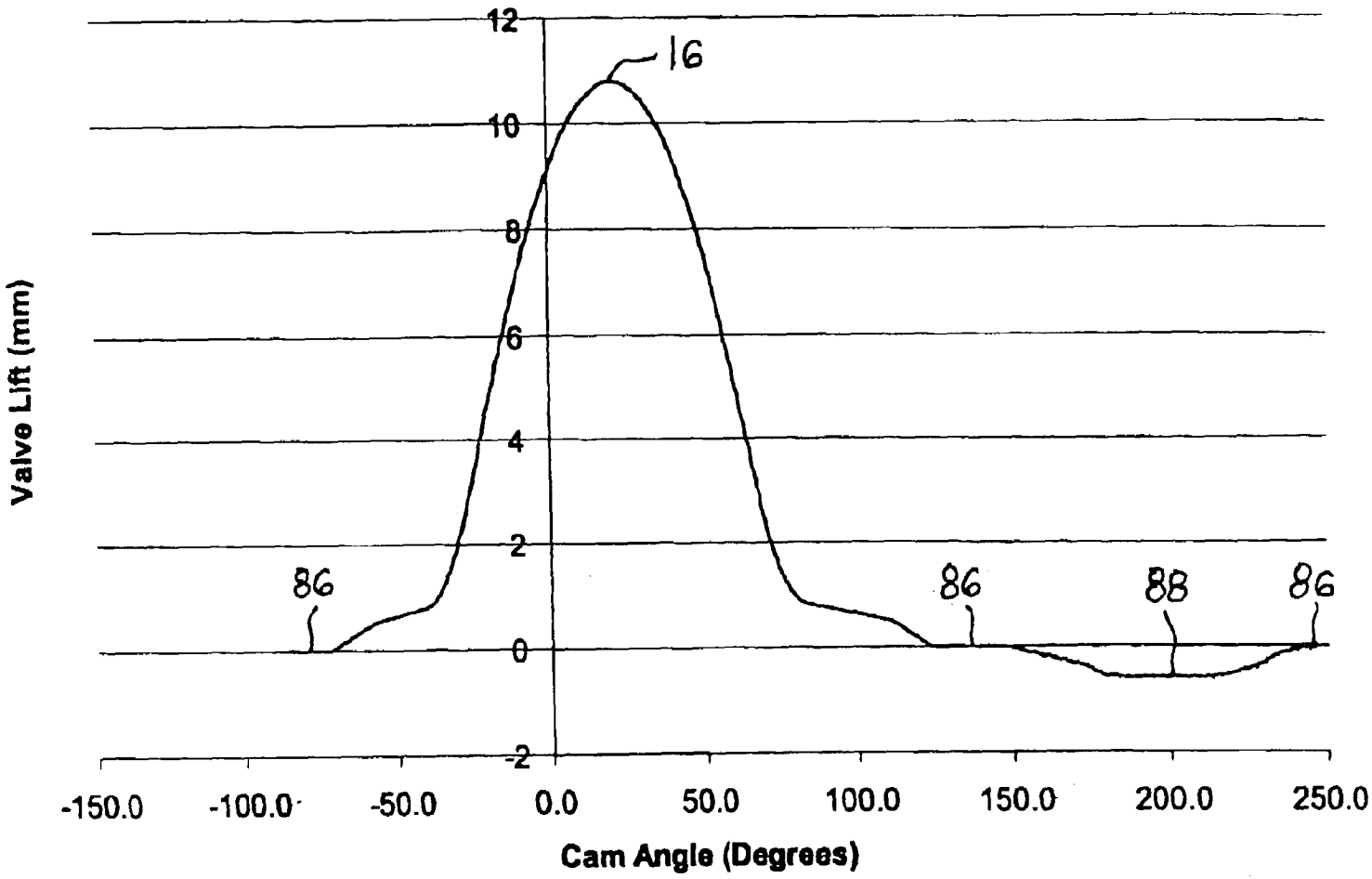
FIG. 4 is a graph of valve lift as a function of cam angle for a cam and roller finger follower in accordance with the invention.

Referring to FIGS. 3 and 4, if latch pin 56 has been moved into engaged position, further rotation of cam 14 serves to move the slider arm back onto the base circle portion 86 of the cam lobe, thereby engaging the slider tip 50 against the latch pin and completing the engagement process. Timing pin return spring 72 urges timing pin 70 back into detent 80, simultaneously urging ball 76 into second groove 84 of latch pin 56 and thereby mechanically locking the latch pin in its engaged position with slider arm 44. As long as hydraulic pressure is maintained on end 58, the mechanism stays latched; however, on every rotation of the cam, slider surface 48 follows the high-lift cam lobe through undercut portion 88, presenting the opportunity for disengagement in every cam revolution. When the ECM removes pressure from the latch pin end, the mechanism will disengage within the next cam revolution. Detent edge 90 urges timing pin away from slider arm 44, allowing ball 76 to retract from groove 84, which allows spring 64 to retract latch pin 56 from engagement with slider tip 50. As in the engagement step, and in an important improvement over the prior art, retraction of latch pin 56 is enabled by, and may occur only during, the following of surface 48 along undercut region 88.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A timing mechanism for alternatively permitting and prohibiting linear actuation of a first pin in a first channel in a body, the first pin having first and second spaced apart detents corresponding to first and second actuation positions of said first pin, the mechanism comprising:

a) a second channel in said body adjacent said first channel;

b) a timing pin slidably disposed in said second channel, said timing pin having a first and larger diameter portion and a second and smaller diameter portion;

c) a passage formed in said body between said first channel and said second channel, said passage having a length and a diameter;

d) a ball disposed in said passage, said ball having a diameter less than said diameter of said passage but greater than said length of said passage such that said ball is freely moveable within said passage and extends into one of said first and second channels at all times; and e) an actuating element for axially displacing said timing pin in said second channel between a first position wherein said larger timing pin diameter portion is adjacent said passage, thereby displacing said ball into a one of said first and second shaft detents to lock said first pin in said first channel, and a second position wherein said smaller timing pin diameter portion is adjacent said passage, allowing said ball to be extended into said second channel and withdrawn from said one of said first and second detents, thereby unlocking said first pin in said first channel.

2. A roller finger follower for use in conjunction with a cam shaft of an internal combustion engine to alternatively activate and deactivate a combustion valve, the cam shaft having at least one lobe, said roller finger follower comprising:

a) an elongate body defining a slider aperture, said body having a pallet end and a socket end, and a latch pin channel and a timing pin channel adjacent said latch pin channel formed in said body, both channels opening onto said slider arm aperture;

b) a slider arm disposed in said slider arm aperture for engaging an actuating surface of said cam lobe having a base circle portion and a positive lift region, said slider arm having a first end and a second end, said first end being mounted to said pallet end of said body for pivotal motion, and said second end defining a slider tip;

c) a latch pin slidably disposed in said latch pin channel for selectively engaging said slider tip to provide positive-lift actuation of said slider arm and for disengaging from said slider tip to provide lost-motion actuation of said slider arm, said latch pin having first and second spaced-apart detents corresponding to positions for said positive lift and lost motion actuations, respectively;

d) a timing pin slidably disposed in said timing pin channel, said timing pin having a larger diameter portion and a smaller diameter portion;

e) a passage formed in said body between said latch pin channel and said timing pin channel, said passage having a length and a diameter;

f) a ball disposed in said passage, said ball having a diameter less than said passage diameter but greater than said passage length such that said ball is freely moveable within said passage and extends into one of said latch pin channel and said timing pin channel at all times; and g) means for axially displacing said timing pin in said timing pin channel between a first timing pin position, wherein said larger diameter portion is adjacent said ball thereby displacing said ball into engagement with a one of said first and second latch pin detents to lock said latch pin in said latch pin channel in a one of said positive lift and lost motion positions, and a second timing pin position wherein said smaller diameter portion is adjacent said ball allowing said ball to be extended into said timing pin channel and withdrawn from said engaged detent said latch pin, thereby unlocking said latch pin in said latch pin channel and permitting said latch pin to move between said positive lift actuation position and said lost motion actuation position.

3. A roller finger follower in accordance with claim 2 wherein said timing pin extends into contact with said slider arm and wherein said means for axially displacing said timing pin comprises:

a) a negative lift region formed on said cam lobe actuating surface and angularly separated from said positive lift region; and b) a feature on said slider arm which engages said timing pin and urges said timing pin from said first timing pin position to said second timing pin position when said slider arm is in contact with said negative lift region.

4. A roller finger follower in accordance with claim 3 wherein:

a) said camshaft comprises at least one second lobe adjacent to, and having a different lift from, said at least one first lobe;

b) said body comprising a first side member and a second side member defining coaxially disposed shaft orifices; and c) a spool roller has a shaft and at least one roller element for engaging said second cam lobe, said shaft of said spool roller being disposed in said shaft orifices.

5. A roller finger follower in accordance with claim 4 wherein said first cam lobe is a high-lift lobe and said second cam lobe is a low-lift lobe.

6. An internal combustion engine comprising a camshaft having a high-lift cam lobe, and comprising a roller finger follower for cooperating with said high-lift cam lobe to selectively adjust the lift of an associated engine valve, wherein said roller finger follower includes, a) an elongate body defining a slider arm aperture, said body having a pallet end and a socket end, and a latch pin channel and a timing pin channel adjacent said latch pin channel formed in said body, both channels opening onto said slider arm aperture;

b) a slider arm disposed in said slider arm aperture for engaging an actuating surface of said high-lift cam lobe, said actuating surface including a base circle portion and a positive lift region, said slider arm having a first end mounted to said pallet end of said body for pivotal motion, and having a second end defining a slider tip;

c) a latch pin slidably disposed in said latch pin channel for selectively engaging said slider tip to provide positive-lift actuation of said slider arm and for disengaging from said slider tip to provide lost-motion actuation of said slider arm, said latch pin having first and second spaced-apart detents corresponding to positions for said positive lift and lost-motion actuations, respectively;

d) a timing pin slidably disposed in said timing pin channel, said timing pin having a first and larger diameter portion and a second and smaller diameter portion;

e) a passage formed in said body between said latch pin channel and said timing pin channel, said passage having a length and a diameter;

f) a ball disposed in said passage, said ball having a diameter less than said passage diameter but greater than said passage length such that said ball is freely moveable within said passage and extends into one of said latch pin channel and said timing pin channel at all times; and g) means for axially displacing said timing pin in said timing pin channel between a first timing pin position, wherein said larger timing pin diameter portion is adjacent said ball thereby displacing said ball into engagement with a one of said first and second latch pin detents to lock said latch pin in said latch pin channel in a one of said positive lift and lost motion positions, and a second timing pin position wherein said smaller timing pin diameter portion is adjacent said ball allowing said ball to be extended into said timing pin channel and withdrawn from said engaged detents in said latch pin, thereby unlocking said latch pin in said latch pin channel and permitting said latch pin to move between said positive lift actuation position and lost motion actuation position.

7. An internal combustion engine in accordance with claim 6 wherein said timing pin extends into contact with said slider arm and wherein said means for axially displacing said timing pin comprises:

a) a negative lift region formed on said cam lobe actuating surface and angularly separated from said positive lift region; and b) a feature on said slider arm which engages said timing pin and urges said timing pin from said first timing pin position to said second timing pin position when said slider arm is in contact with said negative lift region.

8. An internal combustion engine in accordance with claim 7 wherein:

a) said camshaft comprises at least one low-lift lobe additional to said high-lift lobe;

b) said body comprises a first side member and a second side member defining coaxially disposed shaft orifices; and c) a spool roller has a shaft and at least one roller element for engaging said low-lift cam lobe, said shaft of said spool roller being disposed in said shaft orifices.

* * * * *